US011603673B2

(12) United States Patent
Haeberle et al.

(10) Patent No.: US 11,603,673 B2
(45) Date of Patent: Mar. 14, 2023

(54) SUPPORT HEAD HAVING A LOWERABLE SUPPORT HEIGHT FOR A FORMWORK SUPPORT

(71) Applicant: PERI SE, Weissenhorn (DE)

(72) Inventors: Wilfried Haeberle, Langenau (DE); Stephane Gerelli, Chambery (FR)

(73) Assignee: PERI SE, Weissenborn (DE)

( * ) Notice: Subject to any disclaimer, the term of this patent is extended or adjusted under 35 U.S.C. 154(b) by 366 days.

(21) Appl. No.: 16/624,790

(22) PCT Filed: May 30, 2018

(86) PCT No.: PCT/EP2018/064146

§ 371 (c)(1),
(2) Date: Dec. 19, 2019

(87) PCT Pub. No.: WO2018/233993

PCT Pub. Date: Dec. 27, 2018

(65) Prior Publication Data

US 2020/0217091 A1 Jul. 9, 2020

(30) Foreign Application Priority Data

Jun. 19, 2017 (DE) ..... 10 2017 210 195.4

(51) Int. Cl.
*E04G 11/48* (2006.01)
*E04G 25/04* (2006.01)

(52) U.S. Cl.
CPC ..... *E04G 11/486* (2013.01); *E04G 25/04* (2013.01)

(58) Field of Classification Search
CPC ..... E04G 11/50; E04G 2011/505; E04G 2011/483; E04G 2011/486; E04G 2011/38; E04G 2011/48; E04G 2011/52; E04G 2011/56
See application file for complete search history.

(56) References Cited

U.S. PATENT DOCUMENTS 1,888,738 A * 11/1932 Roos ..... E04G 11/486 249/210
1,907,877 A * 5/1933 Roos ..... E04G 11/486 425/DIG. 129

FOREIGN PATENT DOCUMENTS

| | | | | |
|---|---|---|---|---|
| CA | 2416644 A1 * | 7/2004 | ..... | E04G 11/38 |
| CH | 660049 A5 * | 3/1987 | ..... | E04G 11/56 |
| DE | 801952 C * | 1/1951 | ..... | E04G 11/56 |
| DE | 840435 C * | 6/1952 | ..... | E04G 11/56 |
| DE | 8110483 U1 * | 10/1981 | ..... | E04G 11/50 |

(Continued)

*Primary Examiner* — Michael Safavi
(74) *Attorney, Agent, or Firm* — Wei & Sleman LLP

(57) ABSTRACT

A support head for attachment to a formwork support for creating the formwork for a floor using a large number of floor formwork elements which each have a form surface. The support head has two support portions suitable for supporting at least one pair of adjacent floor formwork elements of the large number of floor formwork elements. The support head has an adjustment device for moving a first support portion into an arrangement in which the floor formwork element which can be mounted on the first support portion can be mounted thereon on at least one subjacent mounting point which is at a lower mounting height than a formwork mounting height. The mounting point of the second support portion remains at the formwork mounting height.

19 Claims, 17 Drawing Sheets

(56) References Cited

FOREIGN PATENT DOCUMENTS

| | | | | | |
|---|---|---|---|---|---|
| DE | 19720885 | A1 | * | 11/1998 | ..... E04G 11/56 |
| DE | 19932707 | C1 | * | 2/2001 | ..... E04G 11/38 |
| DE | 10035823 | A1 | * | 2/2002 | ..... E04G 11/56 |
| DE | 10135664 | A1 | * | 2/2003 | ..... E04G 11/486 |
| EP | 0092694 | A2 | | 11/1983 | |
| EP | 0345902 | A2 | * | 12/1989 | ..... E04G 11/486 |
| EP | 1526226 | A1 | * | 4/2005 | ..... E04C 3/005 |
| FR | 1243767 | A | * | 10/1960 | ..... E04G 11/50 |
| FR | 2742787 | A1 | | 6/1997 | |
| GB | 520747 | A | * | 5/1940 | ..... E04G 11/56 |
| GB | 1250875 | A | | 10/1971 | |
| GB | 2265655 | A | * | 10/1993 | ..... E04G 11/486 |
| JP | H0232555 | U | * | 2/1990 | ..... E04G 11/56 |
| KR | 20010054437 | A | * | 7/2001 | ..... E04G 11/56 |
| WO | 2012174598 | | | 12/2012 | |
| WO | WO-2012174597 | A1 | * | 12/2012 | ..... E04G 11/38 |

* cited by examiner

SUPPORT HEAD HAVING A LOWERABLE SUPPORT HEIGHT FOR A FORMWORK SUPPORT

SUMMARY OF THE INVENTION

It is therefore an object of the invention to provide a support head for attachment to a formwork support, a floor formwork system and a method which allows efficient production of a floor using a settable filler material such as concrete.

The object is achieved by a support head, a floor formwork system, and a method.

The support head is designed for attachment to a formwork support, for creating the formwork for a floor using a large number of floor formwork elements which each have a form surface. The support head has a connecting portion for connecting the support head to a shaft portion of the formwork support. The support head further has two support portions which are suitable for supporting at least one pair of adjacent floor formwork elements of the large number of floor formwork elements such that each one of the floor formwork elements of the adjacent pair can be mounted on each of the support portions on at least one mounting point. The mounting points have a substantially equal formwork mounting height. The support head has an adjustment device for moving a first support portion into an arrangement in which the floor formwork element which can be mounted thereon can be mounted thereon on at least one subjacent mounting point which is at a lower mounting height than the formwork mounting height. At the lower mounting height, the mounting point of the second support portion remains at the formwork As a result, a support head is provided which allows efficient disassembly of the formwork supports and of the support heads together with the floor formwork elements when early striking takes place, in order to support the floor by mean of cost-effective tubular steel supports that do not have a complex support head until the desired setting is achieved. Owing to the design of the support head according to the invention, the disassembly can take place efficiently such that no support-free zones result that are already too large for the load caused by the dead weight of the floor. The concrete could be damaged by support-free zones that are too large.

Compared with conventional methods, the support head according to the invention therefore allows early reuse of the support head in a further floor formwork, for example in a subsequent story. As a result, the number of necessary support heads can be reduced and costs for maintaining the support heads can be lowered.

Conventionally, the drop-head supports remain standing in the supporting position after early striking. For this purpose, drop-head supports have been developed which have, in addition to the mounting surface for the formwork, yet another mounting surface for the concrete of the floor. The mounting surface for the formwork has been designed such that said surface can be lowered in order to remove the formwork. These known drop-head supports are constructed such that the concrete comes into contact with the formwork but also with the mounting surface of the drop head directly or via a cover strip. If the concrete comes into contact with different materials, this can lead to undesired traces in the surface of the finished concrete floor.

In comparison, the support head according to the invention makes is possible for the contact between the formwork support and the floor to take place only via the floor formwork elements, since it is no longer necessary for the formwork support having the support head to remain standing after the early striking in order to support the floor. This reduces the risk of undesired traces or impressions on the surface of the concrete floor being produced.

The floor formwork elements can be designed as floor formwork panels. Each of the floor formwork panels can have a form surface and one or more beam elements. The beam elements of the floor formwork panel can be transverse beams and/or longitudinal beams. In this context, transverse and longitudinal beams can be understood to be the side walls of the floor formwork elements.

The adjacent pair of floor formwork elements can be substantially identical. The pair of adjacent floor formwork elements can adjoin one another by the transverse sides thereof or by the longitudinal sides thereof. The adjacent pair of floor formwork elements can be aligned with one another and therefore form a common central axis. Two pairs of floor formwork elements can be mounted on the first and on the second support portion, it being possible to mount two floor formwork elements on the first support portion and two floor formwork elements on the second support portion.

Each of the support portions can have a mounting surface on which the floor formwork element can be placed so as to adjoin. In particular, a portion of a transverse beam and/or a portion of a longitudinal beam of the floor formwork element can be placed on the mounting surface. In the design in which the support portions both form the same formwork mounting height, the mounting surfaces can each be located at the formwork mounting height.

The formwork mounting height and the reduced mounting height can relate to a use position of the support head.

The support portions can each have one or more engagement elements, such as suspension hooks. The suspension hooks can each be open at the top. The suspension hooks can be brought into engagement with a transverse and/or longitudinal beam of the floor formwork element.

The movement of the first support portion can cause a change in a position and/or orientation of the first support portion. During the movement of the first support portion, the second support portion can remain in an unchanged position and/or orientation. The second support portion can be rigidly connected to the connecting portion.

According to one embodiment, the adjustment device is designed such that at least one part of the first support portion is lowered by the movement of the first support portion.

According to a further embodiment, the adjustment device has a guide for the movement of the first support portion. However, it is also conceivable for at least part of the movement to not be guided.

The guide allows controlled movement of the first support portion into the arrangement in which the floor formwork element can be mounted on the subjacent mounting point.

The guide can be designed as a rotary guide and/or as a sliding guide, for example. The sliding guide can be designed to form a straight or curved guide track. For example, the sliding guide can be designed as a linear guide and/or as a slotted guide. At least part of the movement can have a direction component which is oriented toward a floor formwork element, the floor formwork element being mounted on the first support portion. This can make it easier to disengage the floor formwork element from the first support portion.

According to a further embodiment, the guide is designed as a rotary guide.

According to a further embodiment, the rotary guide defines an axis of rotation (A) which is arranged lower than the formwork mounting height.

This can make it easier to disengage the floor formwork element from the first support portion.

According to a further embodiment, the guide is designed as a linear guide and/or as a slotted guide.

The guide can be designed as a rotary sliding guide having an elongate hole for lowering the first support portion in a vertical direction. An elongate hole allows both pivoting of the first support portion and lowering in a straight line in the vertical direction. For lowering in the vertical direction, the relevant floor formwork element furthermore rests flat on the first support portion. The lowered floor formwork element is furthermore held securely in the support head in this lowered position.

The elongate hole can be formed in one end of the first support portion. This makes it possible to pivot the first support portion by means of a rotary arm extending in an elongate manner.

A further embodiment of the support head is characterized in that a pawl is arranged in a rotary bearing of the support head. The pawl rests, in a first end position, on the end of the first support portion having the elongate hole when the first support portion assumes a first bearing position in which the mounting point of the first support portion is located at the formwork mounting height. The pawl automatically slips, when the first support portion is lowered, into a second end position, by means of which a second bearing position of the first support portion is immovably secured. In order to reach the second end position, the pawl can slide, in a rotary movement at the end of the first support portion having the elongate hole, along the outer contour of the first support portion into the second end position. In the second end position, the pawl prevents the first support portion from sliding upward in the vertical direction.

The rotary bearing can have protrusions and/or inwardly curved stops, not exclusively a circular reach-through opening. The pawl can then form a locking angle in relation to the vertical direction when in the second end position. At the locking angle of an inclination of the pawl in the rotary bearing, the pawl can no longer be rotated back into its first end position by a movement of the first support portion, and blocks the first support portion from sliding in the vertical direction.

The pawl can have a reach-through opening. The pawl can be manually unlatched through the reach-through opening. After unlatching, the first support portion can be slid upward again in the vertical direction.

According to a further embodiment, the adjustment device has a releasable locking device. The releasable locking device can releasably lock the movement of the first support portion.

The locking device can be designed such that it can be actuated in a use position of the support head and when all the floor formwork elements which can be mounted on the support head are mounted. The locking device can have a wedge lock, for example. However, other designs of the locking device are conceivable.

The floor formwork system has a large number of formwork supports. The formwork supports are each connected to a support head according to any of the preceding embodiments. The floor formwork system further has the large number of floor formwork elements.

According to a further embodiment, by mounting the floor formwork elements on the first and second support portions of the support heads, a floor form surface can be formed which covers the formwork supports so as to be horizontally closed.

This makes it possible to construct the form surface of a floor exclusively from floor formwork elements. This prevents the concrete coming into contact with various materials which can result in traces or impressions being formed in the surface of the finished floor.

According to a further embodiment, the support head has a moment support. The moment support can be designed to engage with one of the floor formwork elements when said element is mounted on the second support portion. The moment support can be designed to support a torque which is exerted on the support head by a vertical load of the floor formwork element mounted on the second support portion.

This makes it possible to support floor formwork elements on the second support portion in a stable manner, specifically even when no floor formwork element is mounted on the first support portion.

The moment support can act on a surface profile, in particular on a transverse beam or longitudinal beam of the floor formwork element.

According to a further embodiment, the moment support has a supporting portion. The supporting portion can be designed to horizontally support the second support portion on a floor formwork element mounted thereon.

The supporting portion can act on an outer surface of the floor formwork element. In particular, the supporting portion can act on a transverse beam or a longitudinal beam.

According to a further embodiment, the moment support has two supporting portions which are each designed to horizontally support the second support portion on a floor formwork element mounted thereon. The two supporting portions can be designed such that they support the second support portion on the floor formwork element mounted thereon at different heights and in two opposite horizontal directions.

The further supporting portion can act on an inner surface of the floor formwork element, in particular on a transverse beam or a longitudinal beam. The further supporting portion can be designed as suspension hooks. The suspension hooks can be open at the top.

According to a further embodiment, the formwork supports each have a height-adjustment means. The height-adjustment means can be designed to simultaneously adjust the height of the first and the second support portion.

The method is designed to strike the formwork from a floor to be produced using a settable filler material such as concrete. A floor formwork for an underside of the floor being produced has a large number of floor formwork elements and a large number of formwork supports. At least one of the formwork supports is connected to a support head which has two support portions on which at least one pair of adjacent floor formwork elements of the large number of floor formwork elements is mounted such that each one of the floor formwork elements of the adjacent pair is mounted on each of the support portions on at least one mounting point. The mounting points have a substantially equal formwork mounting height. The method comprises moving a first of the support portions into an arrangement in which the floor formwork element mounted on the first support portion can be mounted on at least one subjacent mounting point which is at a lower mounting height than the formwork mounting height. At the lower mounting height, the mounting point of the second support portion remains at the formwork mounting height. The method further comprises striking the formwork from the floor formwork element mounted on the first support portion.

The same advantages as set out above for the support head or the floor formwork system apply, mutatis mutandis, to the method.

According to one embodiment, the floor formwork element mounted on the first support portion is supported by one or more additional supports. The striking may further comprise lowering and/or removing the at least one additional support. The method may comprise disengaging the floor formwork element mounted on the first support portion from the first support portion.

According to a further embodiment, the striking further comprises pivoting down the floor formwork element mounted on the first support portion using engagement elements of the first support portion which are in engagement with the pivoted-down floor formwork element during the pivoting down.

According to a further embodiment, the method comprises supporting the floor, in a region of the floor from which the formwork has been struck, against the ground. The region from which the formwork has been struck may correspond to a form surface of the floor formwork element mounted on the first support portion.

BRIEF DESCRIPTION OF THE DRAWINGS

Embodiments of the present invention are explained with reference to the accompanying drawings, in which.

DETAILED DESCRIPTION

Figure 1A:
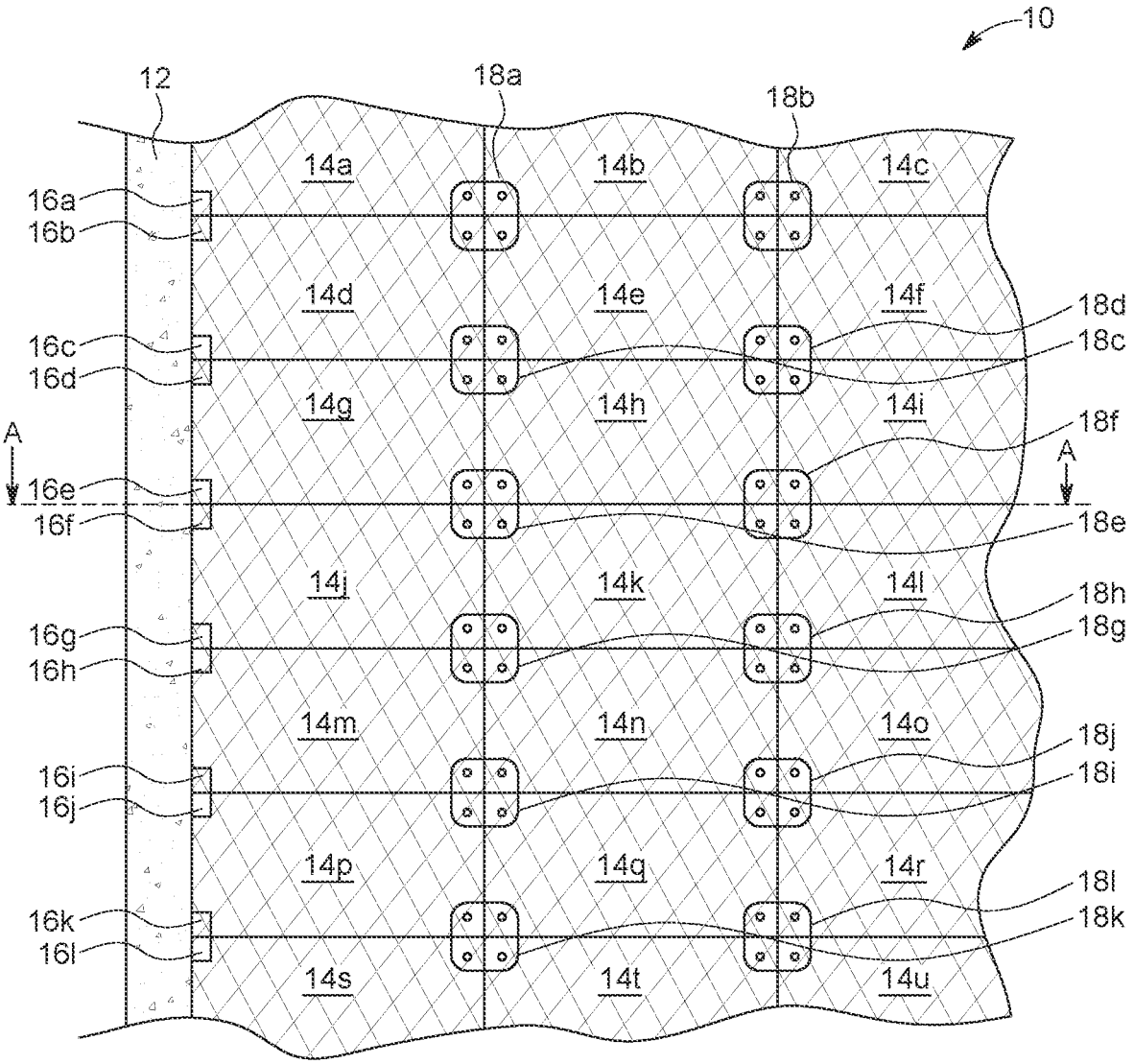
FIG. 1*a*: shows a floor formwork system according to one embodiment.

FIG. 1*a* shows a plan view of a floor formwork system 10 according to one embodiment. The floor formwork system 10 is designed for casting a floor using concrete. In principle, the floor formwork system 10 is also suitable for other settable filler materials. The floor extends in FIG. 1 in the paper plane and is laterally delimited by a concrete wall 12 in the construction shown in FIG. 1*a*. The floor formwork system 10 has a large number of floor formwork elements 14*a* to 14*u* which are each designed as floor formwork panels. The floor formwork panels have sheeting and transverse and longitudinal beams (in particular in the form of longitudinally and transversely extending side walls).

As shown in FIG. 1*a*, each of the floor formwork elements 14*a* to 14*u* is supported at each of its four corners by a formwork support. For this purpose, the floor formwork system 10 has the formwork supports 16*a* to 16*l* and 18*a* to 18*l*. The formwork supports 18*a* to 18*l* are connected to a support head according to the invention, which head is designed as a drop head. The construction of the support head is explained in more detail in the following with reference to FIGS. 2*a* to 5.

The formwork supports 18*a* to 18*l* allow what is referred to as early striking of the floor formwork elements 14*a* to 14*u*, i.e. removing the floor formwork elements 14*a* to 14*u* before the floor has the necessary load-bearing capacity. The floor therefore has to continue to be supported after the early striking. This is conventionally achieved using what are referred to as drop-head supports, which allow at least some of the floor formwork to be disassembled, the drop-head supports remaining standing in order to support the floor until it has the necessary stability.

In comparison, the support heads attached to the formwork supports 18*a* to 18*l* are designed such that, during early striking, the formwork supports 18*a* to 18*l* together with the support heads can be removed efficiently and can be replaced by simply constructed tubular steel supports. This is explained in more detail in the following with reference to FIG. 1*b* to 1*f*. Since the support heads together with the formwork supports 18*a* to 18*l* are cost-intensive in comparison with simply constructed tubular steel supports, the amount of tubular steel supports used can be reduced as a result and it is possible to lower the supply costs. The support heads together with the formwork supports 18*a* to 18*l* can be used for the next forming process, for example in a subsequent story, specifically at an early point in time.

Figure 2A:
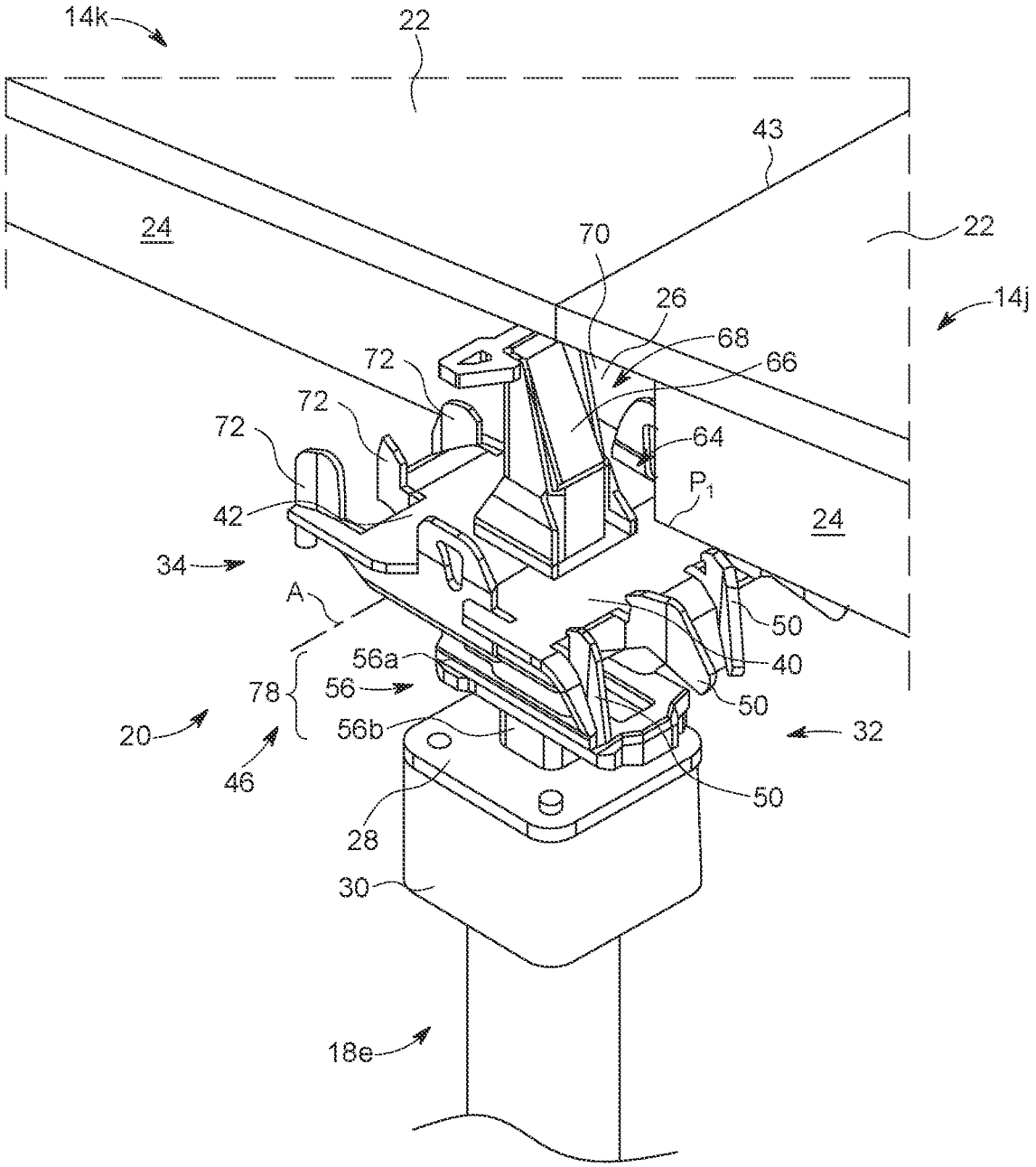
FIG. 2*a*: is a schematic perspective view of a support head of a formwork support in the floor formwork system shown in FIG. 1*a;*
Figure 2B:
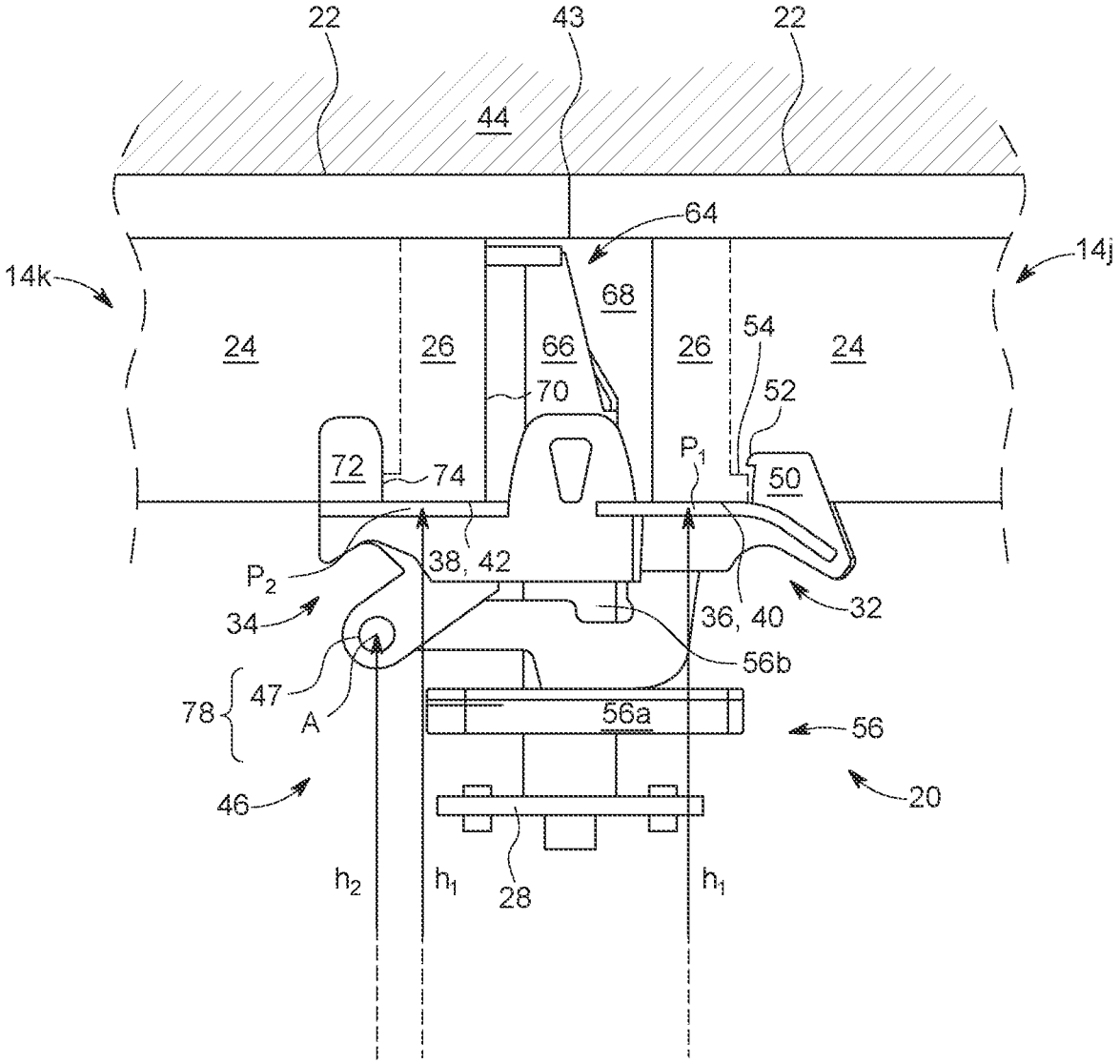
FIG. 2*b*: is a schematic side view of the support head shown in FIG. 2*a;*
Figure 2C:
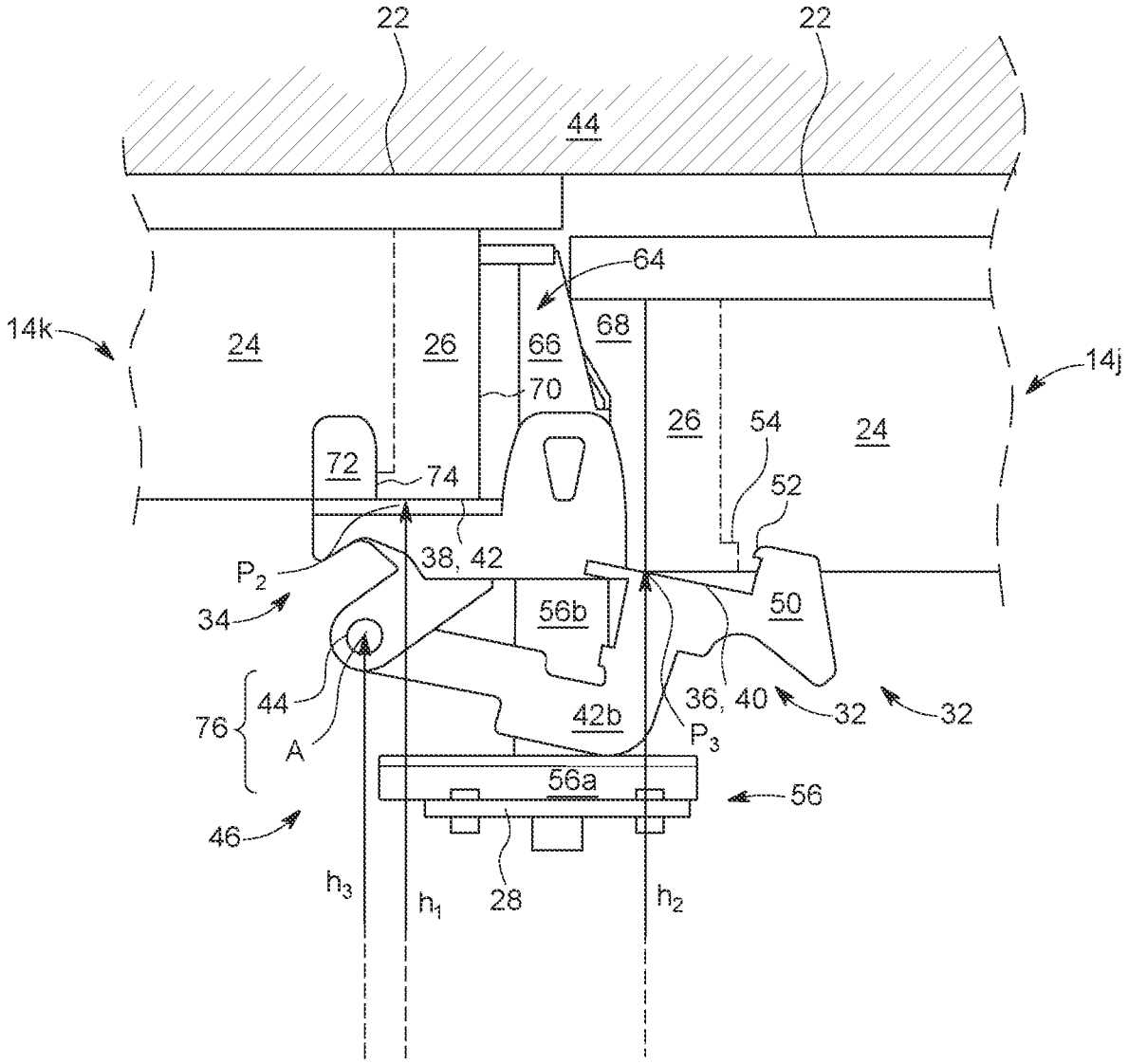
FIG. 2*c*: is a further schematic side view of the support head shown in FIG. 2*b* with the first support portion of the support head being lowered.
Figure 3A:
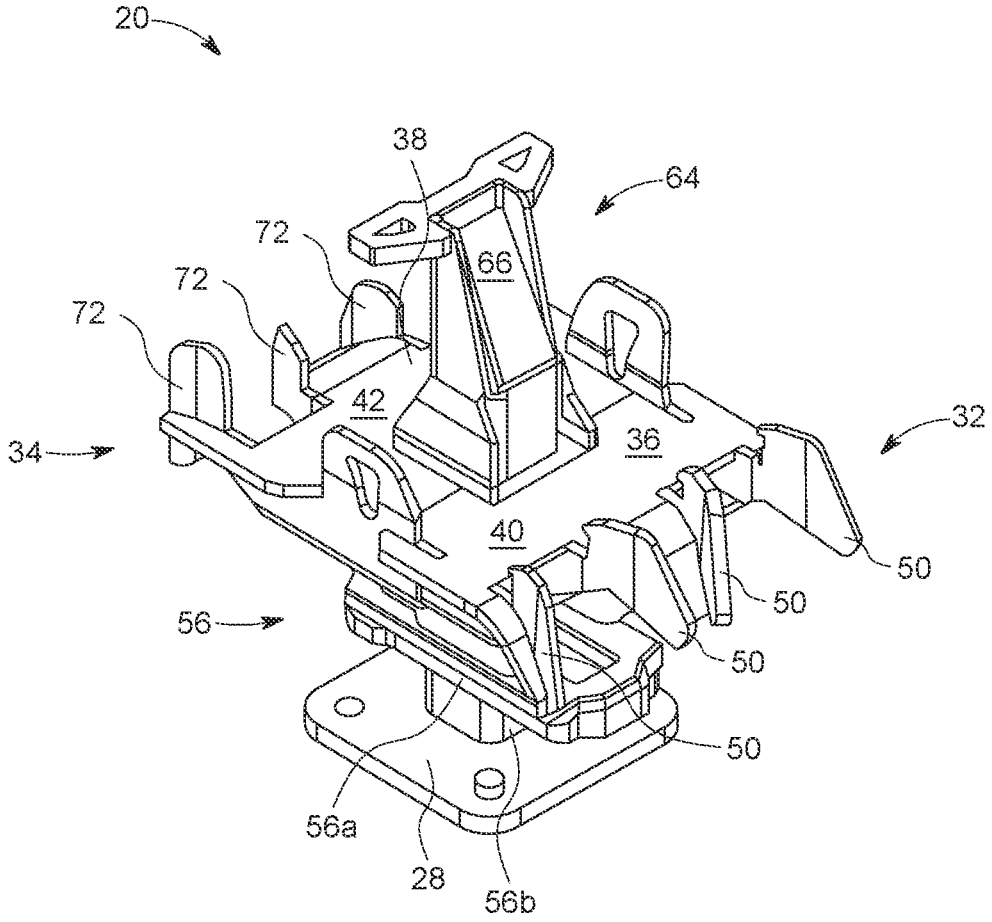
FIG. 3*a*: is a schematic perspective view of the support head shown in FIG. 2*a* without the floor formwork elements.
Figure 3B:
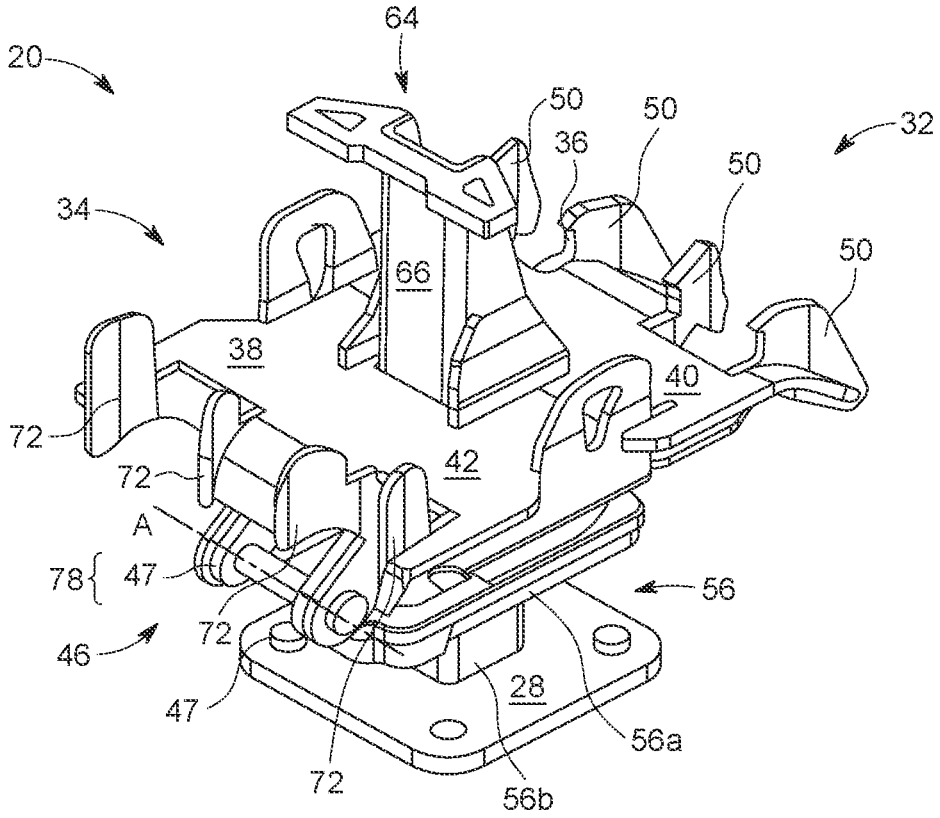
FIG. 3*b*: is a further schematic perspective view of the support head shown in FIG. 2*a* without the floor formwork elements.

FIG. 2*a* is a schematic perspective view of the support head 20 according to the invention and of the formwork support 18*e* together with the floor formwork elements 14*j* and 14*k*, the arrangement of which in the floor formwork system 10 is shown schematically in FIG. 1*a*. In order to simplify the illustration, the floor formwork elements 14*g* and 14*h*, which are also supported by the formwork support 18*e*, are not shown in FIG. 2*a*. FIGS. 2*b* and 2*c* are schematic side views corresponding to the illustration in FIG. 2*a*. FIGS. 3*a* and 3*b* are schematic perspective views of the support head 20 without the floor formwork elements 14*g*, 14*h*, 14*j* and 14*k*.

Each of the floor formwork elements 14*j* and 14*k* shown in FIG. 2*a* has a form surface 22, at least one first beam 24 and at least one second beam 26. Each of the beams 24 and 26 can be a longitudinal beam or a transverse beam and in particular can form a longitudinal wall or a transverse wall.

The support head 20 has a connecting portion 28 for connecting to a shaft portion 30 (FIG. 2*a*) of the formwork support 18*e*. In addition, the support head 20 has two support portions 32 and 34. The support portions 32 and 34 are suitable for supporting the adjacent pair of floor formwork elements 14*j* and 14*k*, the form surfaces 22 of which adjoin one another such that the floor formwork elements 14*j* and 14*k* are aligned with one another and thus form a common central axis. The first beam 24 extends in parallel with the common central axis of the adjacent pair 14*j* and 14*k*. The second beam 26 extends perpendicularly to the common central axis.

The floor formwork element 14*j* is mounted on the first support portion 32. For this purpose, the first support portion 32 has a mounting surface 36 (FIG. 3*a*) on which a portion of the first beam 24 and/or a portion of the second beam 26 of the floor formwork element 14*j* rests. The first support portion 32 therefore has at least one mounting point $P_1$ (FIG. 2*b*) on which the floor formwork element 14*j* is mounted.

The floor formwork element 14*k* is mounted on the second support portion 34. For this purpose, the second support portion 34 has a mounting surface 38 (FIG. 3*b*) on which a portion of the first beam 24 and/or a portion of the second beam 26 of the floor formwork element 14*k* rests. The second support portion 34 therefore has at least one mounting point $P_2$ (FIG. 2*b*) on which the floor formwork element 14*k* is mounted.

The floor formwork element 14*g* (not shown in FIG. 2*a*) can accordingly be mounted on the first support portion 32, for which purpose the first support portion 32 has the mounting surface 40. Furthermore, the floor formwork element 14*h* (not shown in FIG. 2*a*) can be mounted on the second support portion 34, for which purpose the second support portion 34 has the mounting surface 42. Each of these floor formwork elements 14*g* and 14*h* can therefore be mounted on the relevant support portion 32, 34 on at least one mounting point. The floor formwork elements 14*g*, 14*h*, 14*j* and 14*k* are designed such that the form surfaces 22 thereof together form a combined form surface which cover the support head 20 and the formwork support 18 so as to be closed. In particular, the combined form surface is rectangular. For this purpose, each of the floor formwork elements 14*g*, 14*h*, 14*j* and 14*k* has a projecting length on all four peripheral sides. Owing to the projecting length, the form surface 22 projects beyond the first beam 24 and the second beam 26.

As can be seen particularly clearly in FIG. 2*b*, the two mounting points $P_1$ and $P_2$ for the floor formwork elements 14*j* and 14*k* are arranged at an equal formwork mounting height $h_1$. The same applies to the mounting points of the floor formwork elements 14*g* and 14*h* (not shown). In the embodiment shown, this is achieved by the mounting surfaces 36, 38, 40 and 42 being arranged at the same height.

Owing to the equal formwork mounting height $h_1$, a continuous transition 43 is created between the form surfaces 22 of the floor formwork elements 14*g*, 14*h*, 14*j* and 14*k*, which are each in contact with the floor 44 to be produced. In the design of the support head 20, as shown in FIG. 2*a*, the floor 44 is therefore cast.

The support head 20 has an adjustment device 46 for moving the first support portion 32 into an arrangement in which the floor formwork element 14*j* can be mounted on at least one point $P_3$ of the first support portion 32 (FIG. 2*c*), the mounting height $h_2$ of which is lower than the formwork mounting height $h_1$. Accordingly, in this arrangement of the first support portion 32, the floor formwork element 14*g* (not shown in FIG. 2*c*) is also mounted on at least one subjacent mounting point of the support portion 32. The subjacent mounting points for the floor formwork elements 14*g* and 14*j* can be the same or different.

The lower mounting height can lead to the mounted portion of the floor formwork elements 14*g* and 14*j* being lowered. However, it is also conceivable for the floor formwork elements 14*g* and 14*j* to be supported by further formwork supports such that the movement of the first support portion 32 does not automatically lead to the floor formwork elements 14*g* and 14*j* being lowered.

In the embodiment shown in FIGS. 2*a* to 2*c*, the adjustment device 46 has a rotary guide 47 via which the first support portion 32 is pivotably hinged to the second support portion 34. The rotary guide 47 defines an axis of rotation A which is arranged horizontally and perpendicularly to the common central axis of the floor formwork elements 14*j* and 14*k*.

By pivoting the first support portion 32 relative to the second support portion 34, the first support portion 32 is lowered. As shown in FIG. 2*c*, the axis of rotation A is arranged at a height $h_3$ which is lower than the formwork mounting height $h_1$. As a result, at least part of the movement of each of the engagement elements 50 of the first support portion 32 has a direction component which is oriented toward the floor formwork element 14*g* or 14*j*. The engagement elements 50 are designed as suspension hooks and are in engagement with the second beam 26 of the floor formwork element 14*g* or 14*j* mounted on the first support portion 32. The engagement elements 50 each have an end engagement portion 52 (in particular a hook-like projection) for engagement with a substantially horizontal shoulder 54 of the second beam 26. This engagement provides an anti-lift system for the floor formwork elements 14*g* and 14*j*. By means of the above-described design of the movement of the engagement elements 50, it is possible to disengage the end engagement portion 52 and the substantially horizontal shoulder 54. However, embodiments are also conceivable in which the first support portion 32 does not have an anti-lift system, and therefore such a design of the movement is not necessary.

As is explained in the following with reference to FIG. 1*b* to 1*e*, the movement of the first support portion 32 for providing a lower mounting height $h_2$ allows efficient early striking in which the formwork supports 18*a* to 18*l* (FIG. 1*a*) together with the support heads 20 connected thereto can be replaced by simple tubular steel supports which act on the floor 44 without formwork. FIG. 1*c* to 1*e* illustrate cross sections corresponding to the section line A-A indicated in FIG. 1*a*. In order to simplify the illustration, the formwork supports 18*e* and 18*f* and the support heads 20 attached thereto are not shown in the cross section in FIG. 1*c* to 1*e*.

For the floor formwork system 10, it is therefore not necessary for the floor 44 to be supported by the formwork supports 18*a* to 18*l* having the support heads 20 attached thereto after the floor formwork elements 14*a* to 14*u* have been removed. This makes it possible to design the floor formwork system 10 such that a floor form surface which covers the formwork supports 18*a*-18*l* so as to be horizontally closed can be formed by mounting the floor formwork elements 14*a* to 14*u* on the support portions 32 and 34 of the support heads 20.

FIG. 1*c* shows the state before the start of the early striking, as also represented in plan view in FIG. 1*a*. In FIG. 1*a*, the support portions 32 and 34 of the support heads are represented schematically as rounded squares having four dots. For each of the support heads 20 of the floor supports 18*a* to 18*l*, the two support portions 32, 34 are arranged such that they form the formwork mounting height h1 for the floor formwork elements 14*a* to 14*u* mounted on said support portions.

The formwork support 16*f* shown in FIG. 1*c* is, as is also each of the formwork supports 16*a* to 16*e* and 16*g* to 16*l* shown in FIG. 1*a* to 1*b*, a simply constructed tubular steel support without a support head 20, as described with reference to FIGS. 2*a* to 6.

For early striking, in the support heads 20 which are connected to the formwork supports 18*e* and 18*g*, a releasable locking device 56 (FIGS. 2*a* and 2*b*) is released which is designed as a wedge lock in the embodiment shown. However, other embodiments of the releasable locking device 56 are also conceivable.

FIG. 1*d* illustrates a state which is produced by releasing the locking devices 56. By releasing the locking devices 56, the first support portion 32 of the relevant support head 20 is moved into the arrangement shown in FIG. 2*c* in which the floor formwork element 14*j* is mounted on the formwork supports 18*e* and 18*g* at the subjacent mounting height $h_2$.

The floor formwork element 14*k* is furthermore mounted at the formwork mounting height $h_1$ by means of the second support portions 34 of the formwork supports 18*e* and 18*g*. The floor 44 is therefore sufficiently stabilized in the region of the floor formwork element 14*k* and this prevents a support-free zone that is too large being produced, as a result of which the concrete of the floor 44 could be damaged.

Starting from the state which is represented in FIG. 1*d* for the tubular steel supports 16*f*, the tubular steel supports 16*f* and 16*g* (FIG. 1*a*) can be lowered and removed, and the formwork can be struck from the floor formwork element 14*j*, as shown in FIG. 1*e*. By the engagement elements 50 (FIG. 2*c*) being provided on the first support portion 32 of the support head 20 on the formwork support 18*e*, which engagement elements are designed as suspension hooks, the floor formwork element 14*j* can be pivoted down for the striking (illustrated by the arrow 58 in FIG. 1*e*). The pivoting down can be carried out for example using a formwork aid (not shown). The floor formwork element 14*j* can subsequently be disengaged from the engagement elements 50 by the floor formwork system being unhooked from the suspension hooks.

Figure 1B:
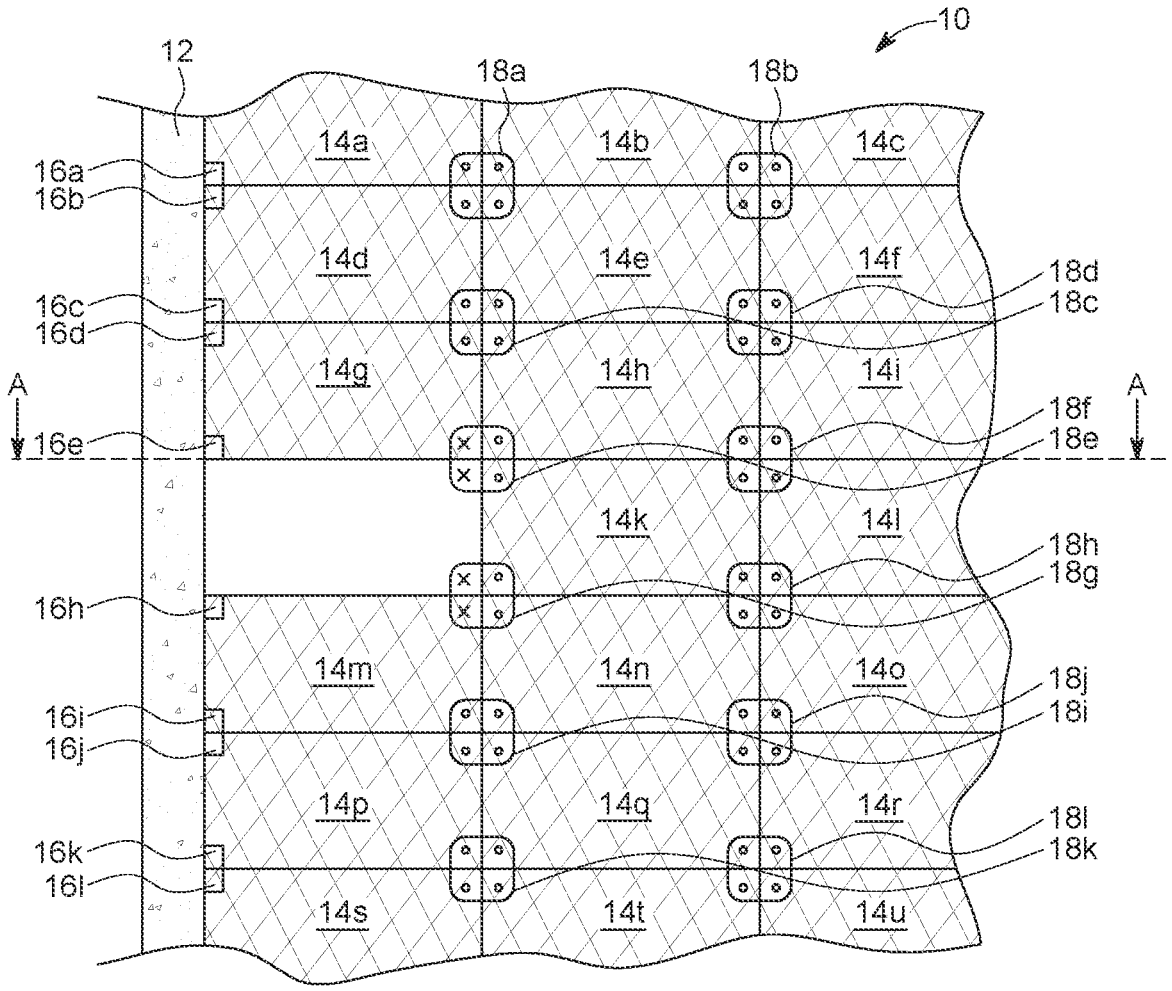
FIG. 1*b*: shows the floor formwork system shown in FIG. 1*a* with one of the floor formwork elements having been removed.
Figure 1C:
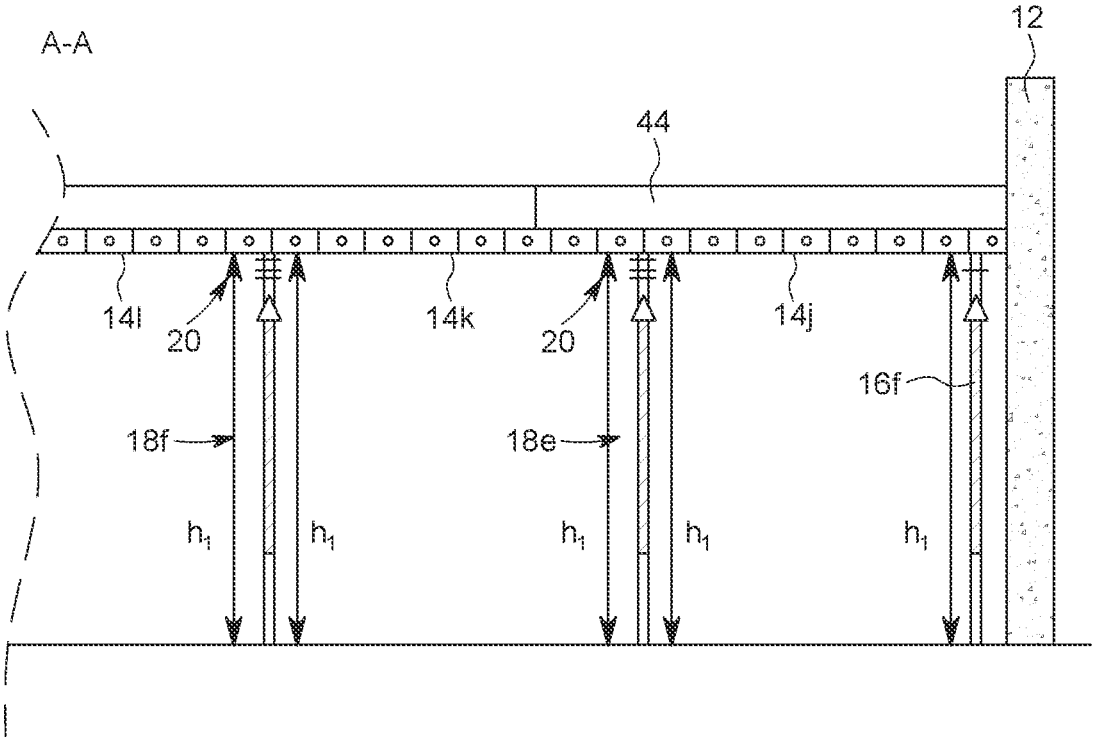
FIG. 1*c* to 1*f*: are vertical cross sections through the floor formwork system corresponding to the section lines shown in FIGS. 1*a* and 1*b;*
Figure 1D:
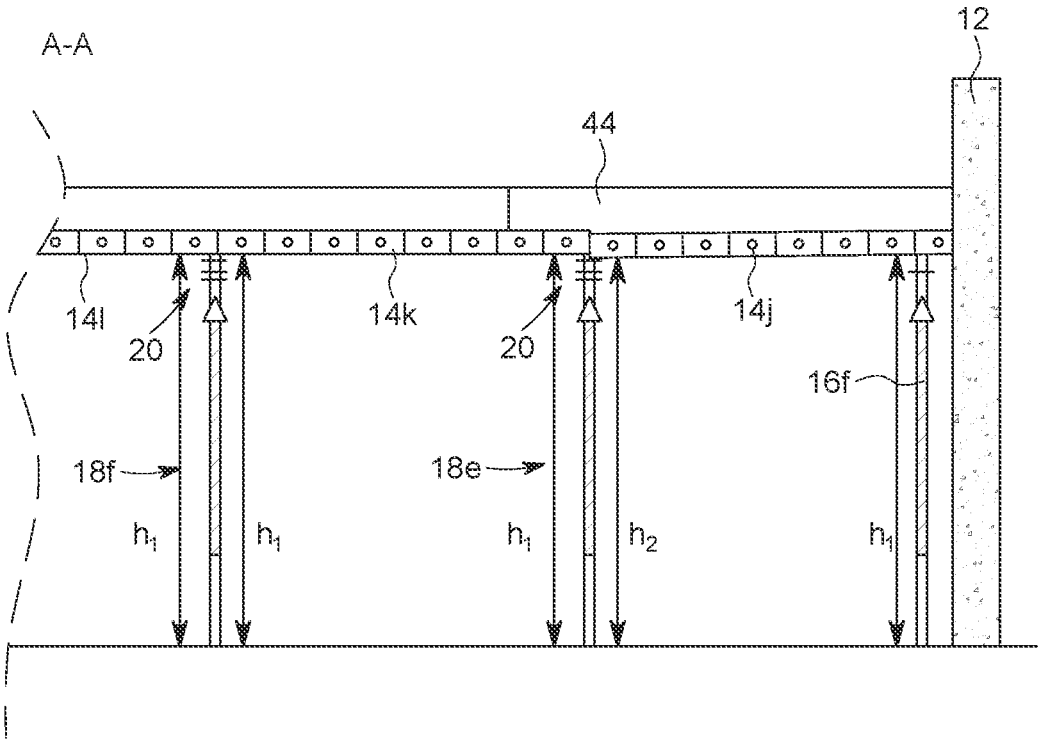
Figure 1E:
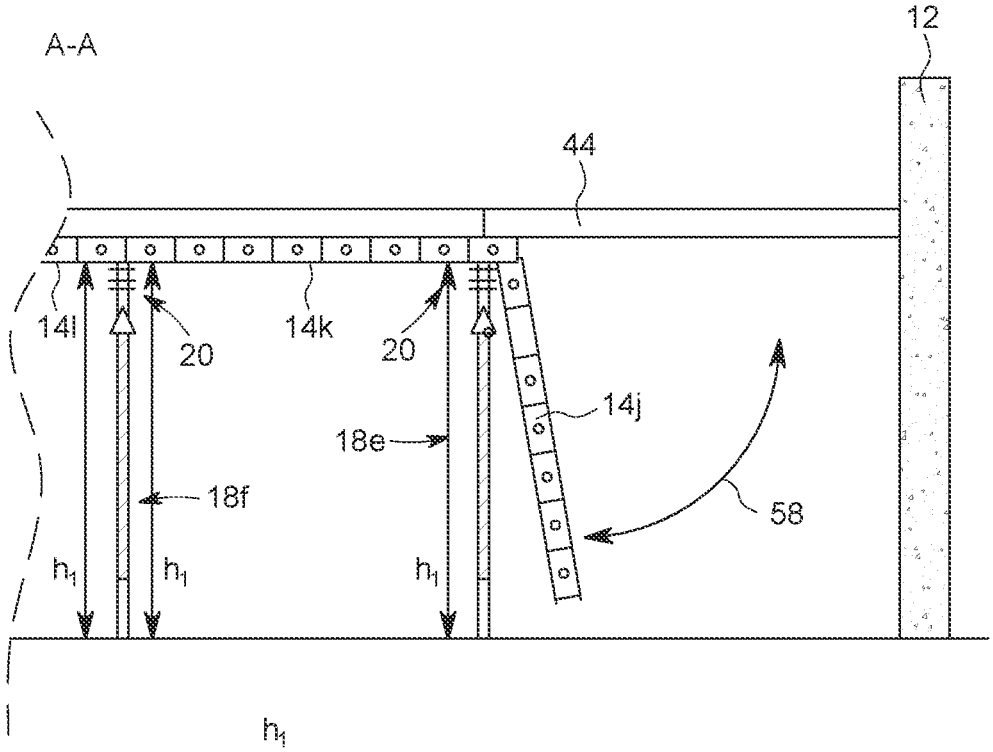
Figure 1F:
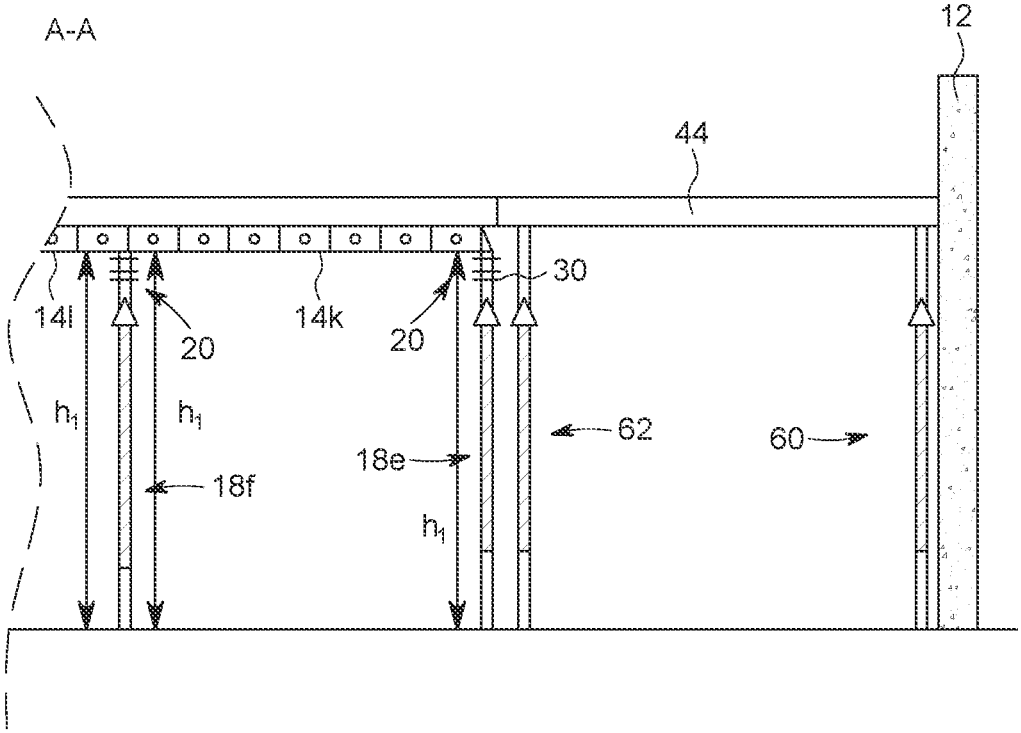

The state after the formwork has been struck from the floor formwork element 14*j* is shown in FIGS. 1*b* and 1*f*. The lowered first support portions 32 of the support heads 20 on the formwork supports 18*e* and 18*g* are marked by crosses in FIG. 1*b*. The mounting points which are located at the formwork mounting height h1 are marked by dots. As therefore shown in FIG. 1*b*, the floor formwork element 14*k* is mounted on the formwork supports 18*e* and 18*g* at the formwork mounting height h1 by means of the second support portions 34 of the support heads 20. As a result, the floor is sufficiently supported in the region of the floor formwork element 14*k*.

In addition, as shown in FIG. 1*b*, the floor formwork elements 14*g* and 14*m* are mounted at the formwork mounting height h1 on three corners. As a result, the floor 44 is also sufficiently supported in the region of these floor formwork elements.

In the event that, rather than tubular steel supports 16*a* to 16*l* (FIG. 1*b*), double supports are used which each support two adjacent floor formwork elements, when the floor formwork element 14*j* is removed there is no further mounting for the floor formwork elements 14*g* and 14*m* corresponding to the tubular steel supports 16*e* and 16*h* shown in FIG. 1*b*. However, the floor formwork elements 14*g* and 14*m* are generally sufficiently stabilized by the concrete wall 12 such that it is not necessary to add further supports in order to stabilize the floor formwork elements 14*g* and 14*m*. If the floor formwork elements 14*g* and 14*m* are not sufficiently stabilized by the concrete wall 12, it is conceivable to temporarily add tubular steel supports for stabilization.

As shown in FIG. 1*f*, after the floor formwork element 14*j* has been removed, the region of the floor 44 from which the floor formwork element 14*j* has been struck is supported by tubular steel supports 60 and 62.

In further steps of the early striking, the further floor formwork elements (14*a* to 14*i* and 14*k* to 14*u*) and the formwork supports (18*a* to 18*l*) together with the support heads 20 attached thereto can be removed one by one and replaced by tubular steel supports. The support head 20 makes it possible to carry out this process efficiently without a support-free zone that is too large being produced. In order to remove the formwork supports 18*a* to 18*l*, said supports each have a height-adjustment means for adjusting the height of the entire support head 20. The height-adjustment means can be designed for a telescopic height adjustment, for example.

In the state shown in FIG. 1*f*, a torque is exerted on the support head 20 which is connected to the formwork support 18*e*, which torque is generated by the vertical load of the floor formwork element 14*k* and the support force of the shaft portion 30. Due to the missing floor formwork element 14*j*, this torque cannot be compensated for.

In order to support this torque and thereby keep the maintenance and repair costs for the formwork support 18*e* low, the support head 20 has a moment support 64 (FIGS. 2*a* to 2*c*, 3*a* and 3*b*). The moment support 64 is in engagement with the floor formwork elements mounted on the second support portion 34, i.e. in particular with the floor formwork element 14*k* shown in FIG. 1*f*, and is rigidly connected to the second support portion 34.

The moment support 64 has a supporting portion 66 which is arranged in a gap 68 formed by all of the floor formwork elements 14*g*, 14*h*, 14*j* and 14*k* which can be mounted on the support head 20. The first supporting portion 66 is in engagement with an outer vertical surface 70 of the floor formwork elements 14*h* and 14*k* which are mounted on the second support portion 34. The outer vertical surface 70 is the surface of the second beam 26. The second support portion 34 is supported horizontally on each of the floor formwork elements 14*h* and 14*k* by means of the supporting portion 66.

The torque is already effectively supported by means of the supporting portion 66. The torque can be even better supported by one or more further supporting portions 72, by means of which the second support portion 34 is supported on the mounted floor formwork elements 14*h* and 14*k*, likewise in a horizontal direction. The further supporting portions 72 are each in engagement with a vertical surface 74 of the corresponding floor formwork element 14*h* and 14*k*, which surface faces toward the interior of the relevant floor formwork element 14*h* and 14*k*. The inwardly facing vertical surface 74 is a surface of the second beam 26 of the relevant floor formwork element 14*h* and 14*k*. As shown in particular in FIG. 2*b*, the supporting portion 66, and the further supporting portions 72, supports, at different heights and in two opposite horizontal directions, the second support portion 34 on the floor formwork elements 14*h* and 14*k* mounted thereon. The supporting portion 66 engages at a greater height than the further supporting portions 72.

Figure 4A:
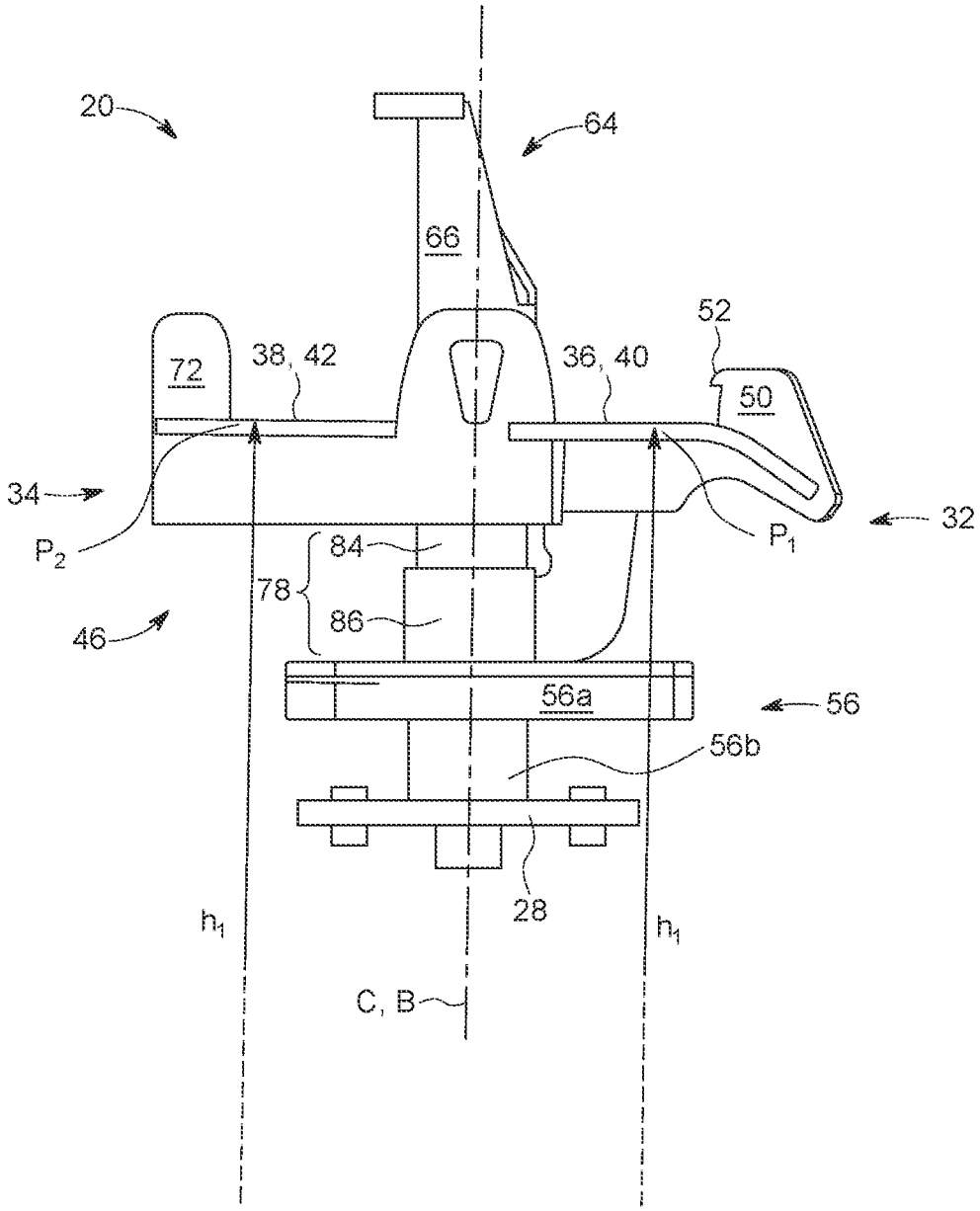
FIG. 4*a*: is a schematic side view of a support head according to a second embodiment.
Figure 4B:
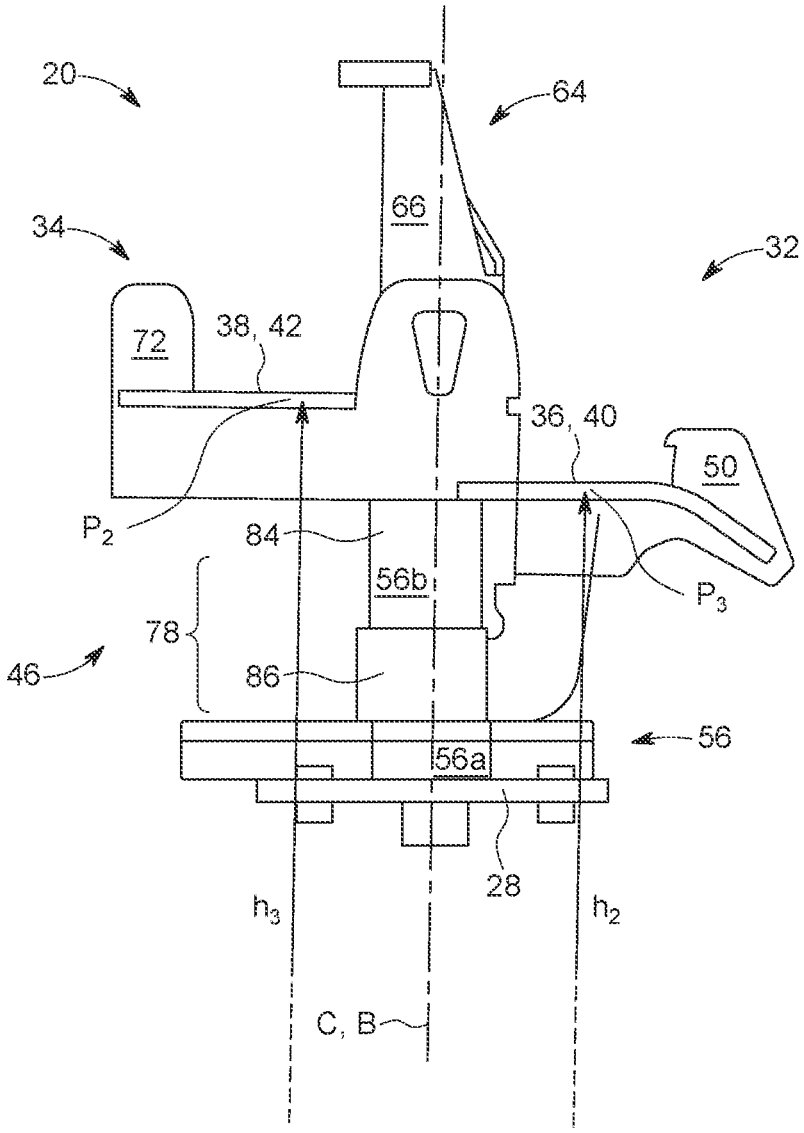
FIG. 4*b*: is a further schematic side view of the support head shown in FIG. 4*a* with the first support portion being lowered.
Figure 5:
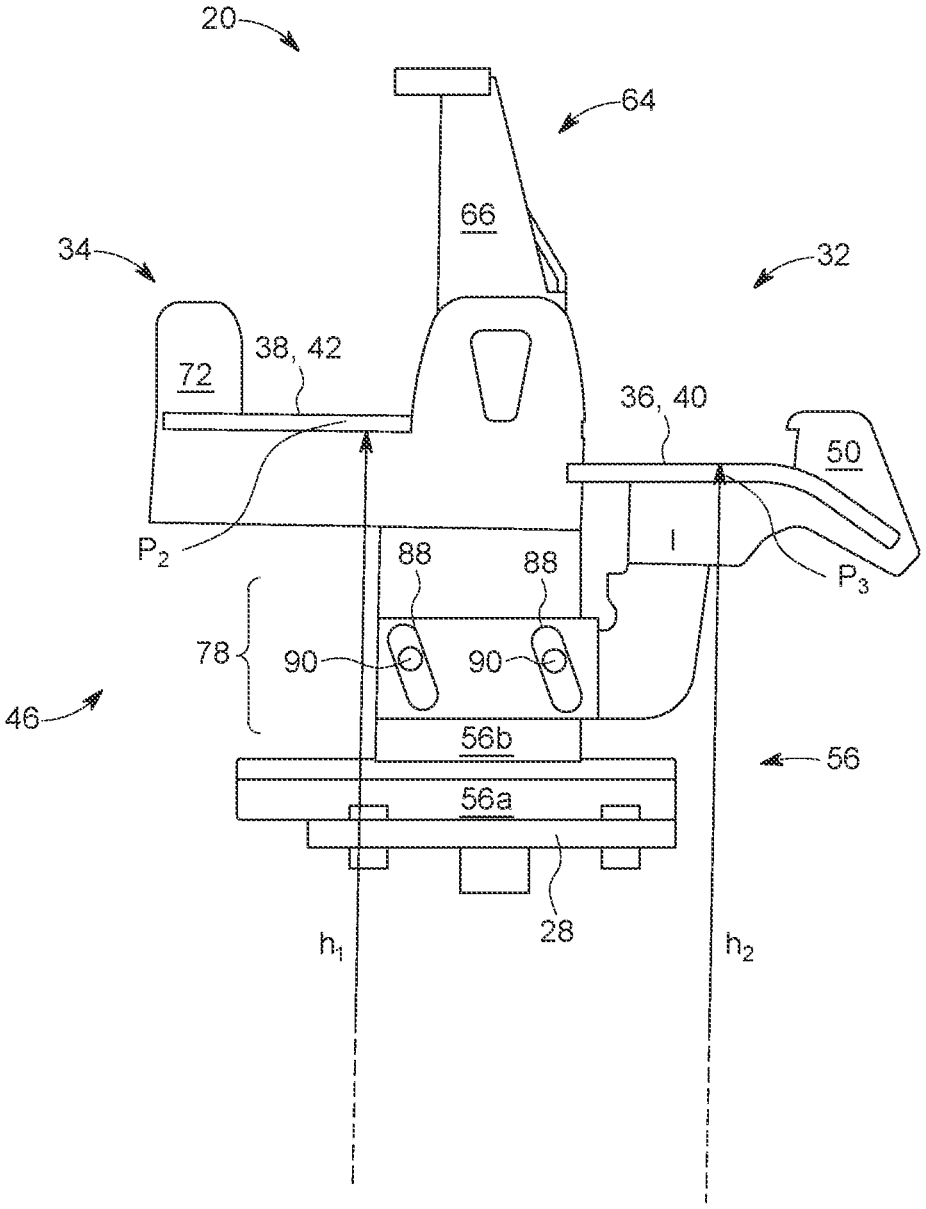
FIG. 5: is a schematic side view of a support head according to a third embodiment with the first support portion being lowered.

FIGS. 4*a* to 5 show alternative embodiments for the support head 20 in which the guide 78 of the adjustment device 46 has a different design. FIGS. 4*a* and 4*b* show an embodiment in which the guide 78 is designed as a sliding guide, specifically as a linear guide. The linear guide has a guide arm 84 on which a guide sleeve 86 is arranged so as to move longitudinally. An axis B of the guide arm 84 extends in parallel with a longitudinal axis C of the formwork support (18*a* to 18*l*) to which the support head 20 is attached. FIG. 4*a* shows the state in which the floor formwork elements are mounted on the two support portions 32 and 34 at the formwork mounting height $h_1$. FIG. 4*b* shows the state in which the first support portion 32 is lowered in order to mount the floor formwork elements mounted thereon at the lowered mounting height $h_2$.

FIG. 5 shows a further alternative embodiment for the support head 20, in which the sliding guide is designed as a slotted guide. The slotted guide can be designed such that the guide track of the first support portion 32 is linear. Alternatively, it is also conceivable that the slotted guide is designed such that the guide track of the first support portion 32 extends in a curved manner. In the embodiment shown in FIG. 5, the slotted guide has the slotted links 88 which are arranged so as to be moveable relative to the rigidly arranged slotted-link blocks 90. However, other embodiments of the slotted guide are also conceivable. By means of the slotted guide shown in FIG. 5, it is in particular possible for the guide track of the slotted guide to be designed such that at least part of the movement of the first support portion 32 has a direction component which are oriented toward the floor formwork elements which are mounted on the first support portion 32. As has already been described above with reference to the rotary guide 47 (FIGS. 2*a* to 3*b*), this makes it possible to easily disengage the floor formwork element from the engagement portion 52 of the engagement element 50.

By means of the embodiments shown, a support head 20, a floor formwork system 10, and a method are provided which allow efficient production of a floor 44 made of a settable filler material such as concrete.

Figure 6:
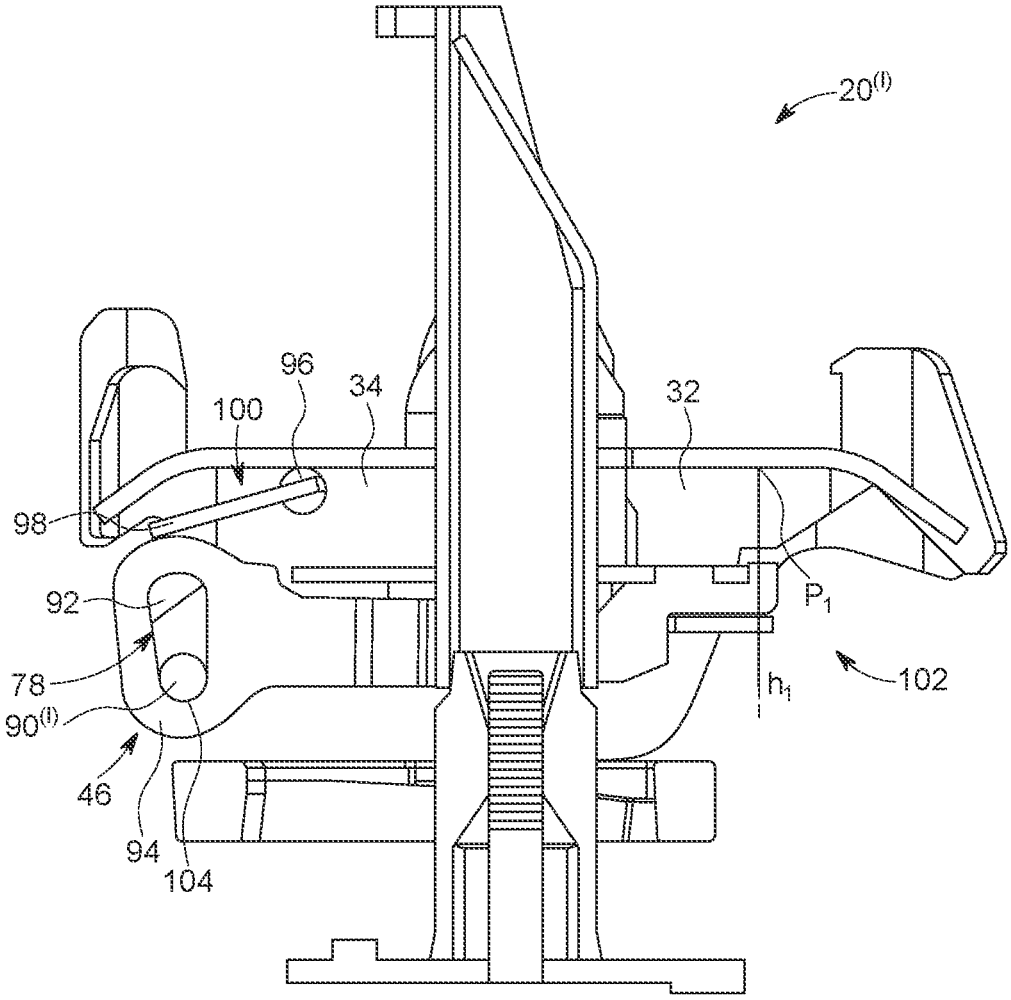
FIG. 6: is a longitudinal section through a fourth embodiment of a support head having a first support portion in a first bearing position.

FIG. 6 is a longitudinal section through a fourth embodiment of a support head $\mathbf{20}^{(I)}$. The guide 78 is designed as a rotary sliding guide. For this purpose, the guide 78 has an elongate hole 92 which is oriented in the vertical direction. The elongate hole 92 is formed in one end 94 of the first support portion 32, the end 94 being arranged on the second support portion 34 or cooperating with the second support portion 34. A slotted-link block $\mathbf{90}^{(I)}$ formed on the second support portion 34 is located in the elongate hole 92 so as to be immovably attached in the second support portion 34. A pawl 98 is positioned in a rotary bearing 96 of the second support portion 34. In a first end position 100 shown in FIG. 6, the pawl 98 rests on the end 94 of the first support portion 32 having the elongate hole 92. The first support portion 32 assumes a first bearing position 102 in which the mounting point $P_1$ is located at the formwork mounting height $h_1$. The slotted-link block $\mathbf{90}^{(I)}$ is located at the lower end 104 of the elongate hole 92. In this fourth embodiment, as also in the embodiment shown in FIGS. 2*a* to 3*b*, the first support portion 32 is integrally formed and connected to the second support portion 34 via the adjustment device 46.

Figure 7:
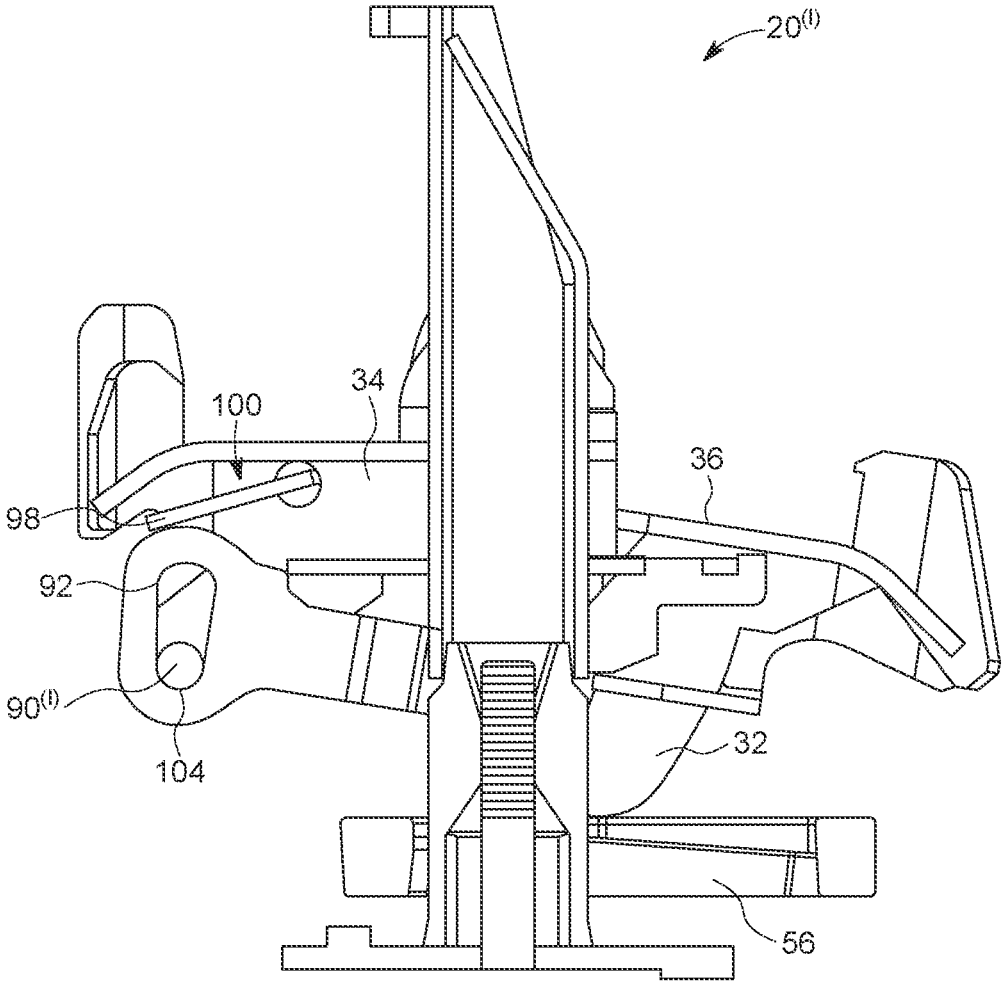
FIG. 7: is a longitudinal section through the support head in the fourth embodiment after the first support portion has been pivoted.

FIG. 7 shows a longitudinal section through the support head $\mathbf{20}^{(I)}$ in the fourth embodiment after the first support portion 32 has been lowered in relation to the second support portion 34 by pivoting the first support portion 32 after the locking device 56 has been released. The pawl 98 remains in the first end position 100. The slotted-link block $\mathbf{90}^{(I)}$ is still located at the lower end 104 of the elongate hole 92. The mounting surface 36 is oriented obliquely in relation to the vertical direction.

Figure 8:
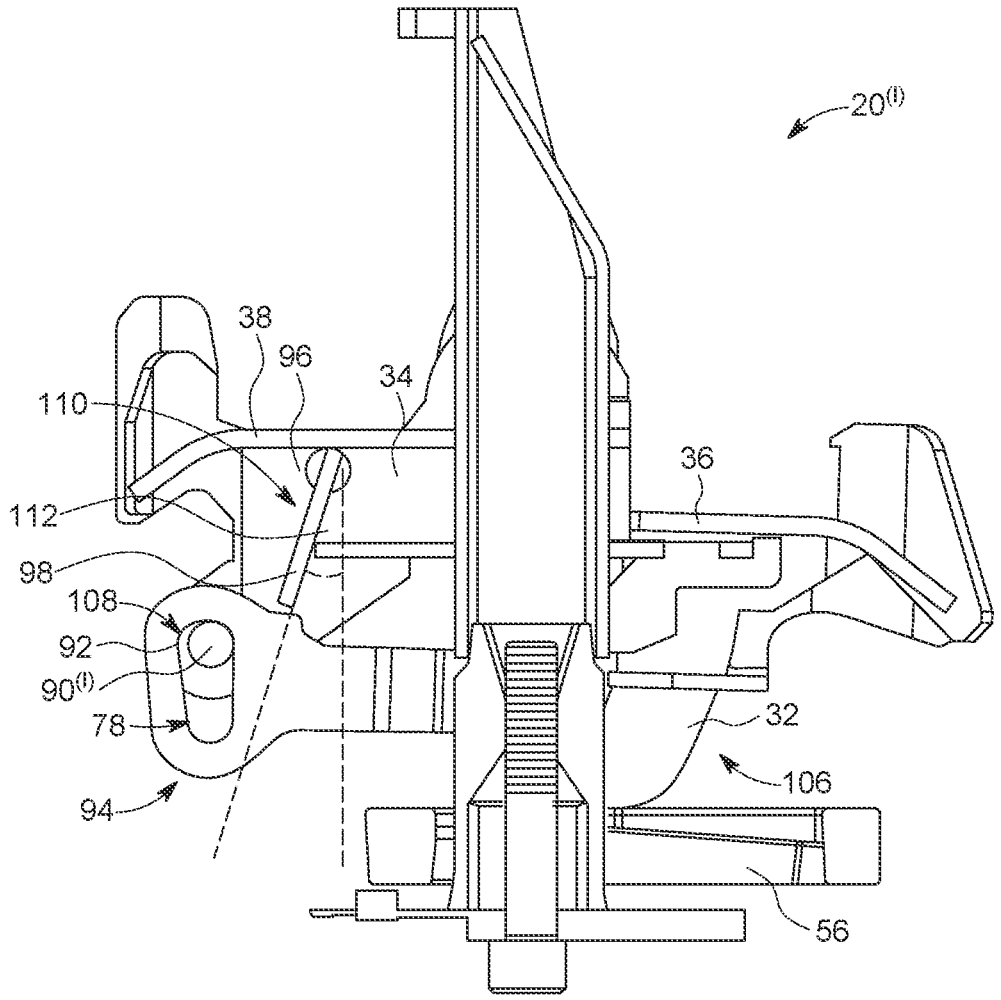
FIG. 8: is a longitudinal section through the support head in the fourth embodiment having the first support portion in a second bearing position.

FIG. 8 is a longitudinal section through the support head $\mathbf{20}^{(I)}$ in the fourth embodiment, the first support portion 32 assuming a second bearing position 106. The first support portion 32 rests on the released locking device 56. The mounting surface 36 of the first support portion 32 is oriented in parallel with the mounting surface 38 of the second support portion 34. The slotted-link block $\mathbf{90}^{(I)}$ is located at the upper end 108 of the elongate hole 92 of the guide 78. In order to reach the second bearing position 106 of the first support portion 32, after the first support portion 32 has been pivoted as shown in FIG. 7, the elongate hole 92 has been guided downward in the vertical direction along the slotted-link block $\mathbf{90}^{(I)}$, for example due to the load of the floor formwork element 14*j* resting on the mounting surface 36 (see FIG. 2*b*). The pawl 98 is located in a second end position 110 in which the pawl 98 immovably secures the first support portion 32 in the second bearing position 106, and prevents the first support portion 32 from sliding out of the second bearing position 106. In this end position, the pawl forms a locking angle 112, with the pawl 98 in the rotary bearing 96 being inclined with respect to the vertical direction. At the locking angle 112, the pawl 98 can no longer be rotated back into its first end position by a movement of the first support portion 32 upward in the vertical direction, and blocks the first support portion 32 from sliding upward in the vertical direction. In order to reach the second end position 110, the pawl 98 arranged in the rotary bearing 96 drops automatically out of its first end position 100 (see FIG. 6) and slides, in a rotary movement at the end 94 of the first support portion 32 having the elongate hole 92, along the outer contour of the first support portion 32 into the second end position 110.

Figure 9:
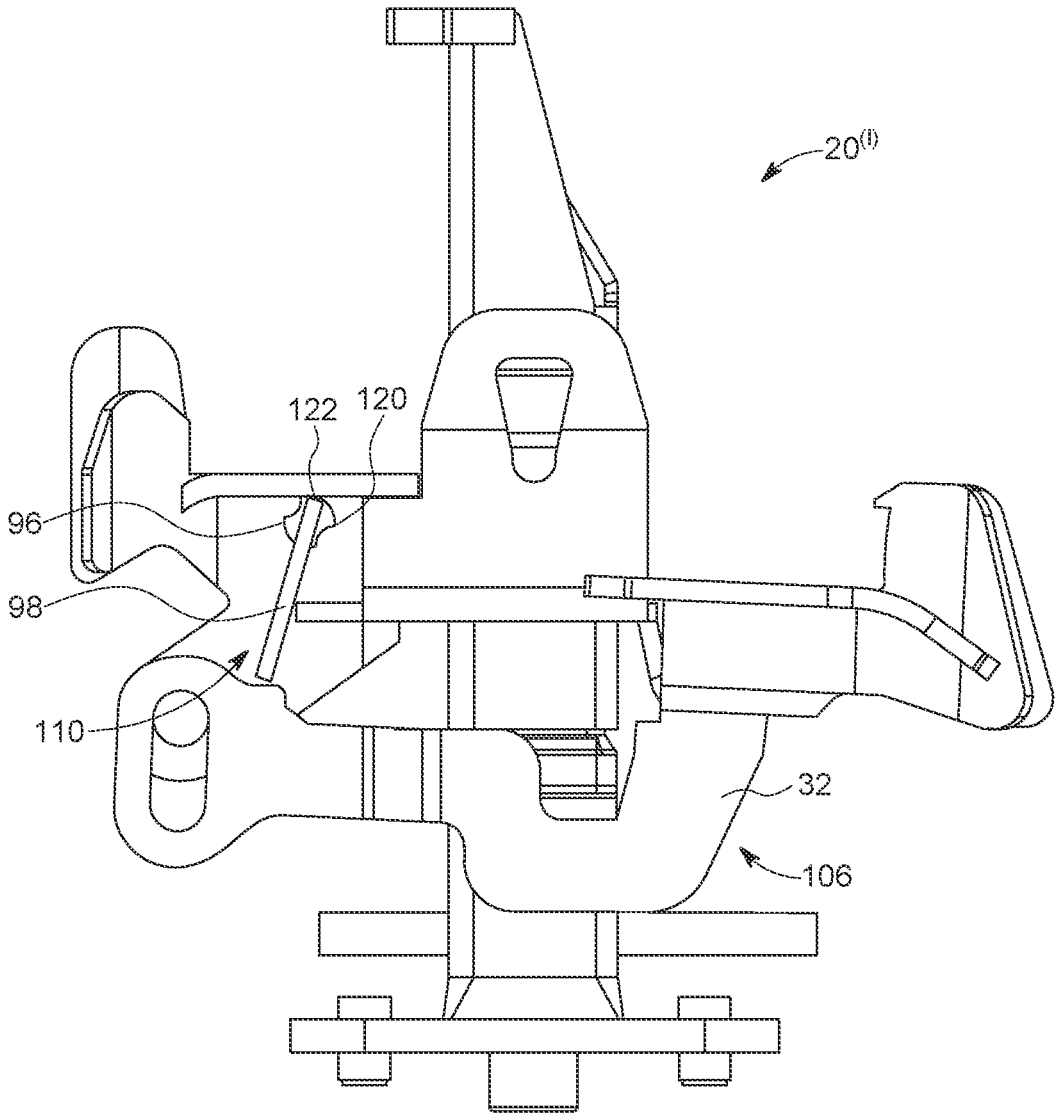
FIG. 9: is a longitudinal section through the support head in the fourth embodiment having the first support portion in a second bearing position and a detailed view of a rotary bearing for a pawl of the support head.

FIG. 9 is a longitudinal section through the support head $\mathbf{20}^{(I)}$ in the fourth embodiment having a detailed view of the rotary bearing 96, the first support portion 32 assuming the second bearing position 106. In the second end position 110, the pawl 98 rests on the first support portion 32. The rotary bearing 96 has a protrusion 120, on the upper end of which an inwardly curved stop 122 for the pawl 98 is formed. When a force is applied by the first support portion 32 upward in the vertical direction, the rotary movement of the pawl 98 resulting from this application of force is blocked by the stop 122. The pawl 98 can no longer be rotated back into its first end position 100 (see FIG. 6) by a movement of the first support portion 32 upward in the vertical direction. The pawl 98 thus blocks the first support portion 32 from sliding upward in the vertical direction. The pawl 98 can be manually released from its locking function and slid back into the first end position 100.

Figure 10:
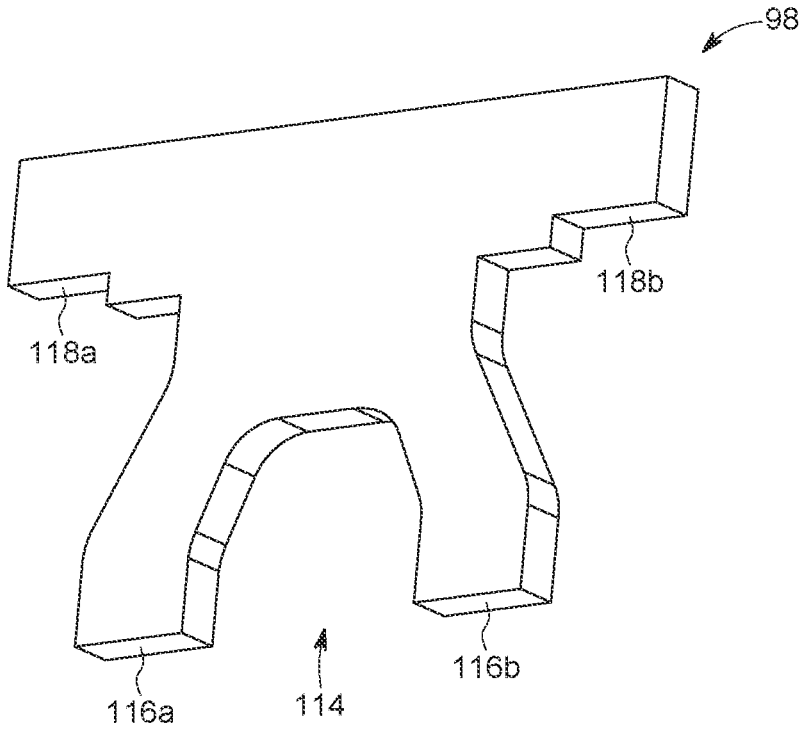
FIG. 10: is an isometric illustration of the pawl of the support head in the fourth embodiment.

FIG. 10 is an isometric view of the pawl 98. The pawl 98 has a reach-through opening 114. A finger, for example, can reach through the reach-through opening 114 in order to move the pawl from the second end position 110 (see FIG. 8) back into the first end position 100 (see FIG. 6). The pawl 98 further has two locking edges 116*a*, 116*b* which rest on the first support portion 32 (see FIG. 8). The pawl 98 can be fastened and guided in the rotary bearing 96 (see FIG. 6) by means of two bearing directing surfaces 118*a*, 118*b*.

A support head (20, $\mathbf{20}^{(I)}$) is thus disclosed for attachment to a formwork support (18*a*-18*l*) for creating the formwork for a floor (44) using a large number of floor formwork elements (14*a*-14*u*) which each have a form surface (22). The support head (20, 20$^{(I)}$) has two support portions (32, 34) suitable for supporting at least one pair of adjacent floor formwork elements (14*j*, 14*k*) of the large number of floor formwork elements (14*a*-14*u*). The support head (20, 20$^{(I)}$) has an adjustment device (46) for moving a first support portion (32) into an arrangement in which the floor formwork element (14*j*) which can be mounted on the first support portion (32) can be mounted thereon on at least one subjacent mounting point ($P_3$) which is at a lower mounting height ($h_2$) than the formwork mounting height ($h_1$). The mounting point ($P_2$) of the second support portion (34) remains at the formwork mounting height ($h_1$).

The invention claimed is:

1. A support head for attachment to a formwork support for creating the formwork for a floor using a plurality of floor formwork elements which each have a form surface; wherein the support head has:

a connecting portion for connecting the support head to a shaft portion of the formwork support;

two support portions configured for supporting at least one pair of adjacent floor formwork elements of the plurality of floor formwork elements such that each one of the floor formwork elements of the adjacent pair can be mounted on each of the support portions on at least one mounting point;

wherein the mounting points have a substantially equal formwork mounting height;

wherein the support head has an adjustment device for moving a first support portion into an arrangement in which the floor formwork element which can be mounted on the first support portion can be mounted thereon on at least one subjacent mounting point which is at a lower mounting height than the formwork mounting height, wherein the adjustment device has a guide configured as a rotary sliding guide having an elongate hole for lowering the first support portion in a vertical direction;

wherein at the lower mounting height, the mounting point of the second support portion remains at the formwork mounting height.

2. The support head according to claim 1, wherein the adjustment device is configured such that at least one part of the first support portion is lowered by the movement of the first support portion.

3. The support head according to claim 1, wherein the guide is configured for the movement of the first support portion.

4. The support head according to claim 1, wherein the elongate hole is formed in one end of the first support portion.

5. The support head according to claim 4, wherein a pawl is arranged in a rotary bearing of the support head, the pawl resting, in a first end position, on the end of the first support portion having the elongate hole when the first support portion assumes a first bearing position in which the mounting point $P_1$ of the first support portion is located at the formwork mounting height, the pawl automatically slipping, when the first support portion is lowered, into a second end position, by means of which a second bearing position of the first support portion is immovably secured.

6. The support head according to claim 5, wherein the pawl has a reach-through opening.

7. The support head according to claim 1, wherein the adjustment device has a releasable locking device which releasably locks the movement of the first support portion.

8. A floor formwork system, having:

a plurality of formwork supports to each of which a support head according to claim 1 is attached, and the plurality of floor formwork elements.

9. The floor formwork system according to claim 8, wherein by mounting the floor formwork elements on the support portions of the support heads, a floor form surface can be formed which covers the formwork supports so as to be horizontally closed.

10. The floor formwork system according to claim 8, wherein the support head has a moment support which is configured to engage with one of the floor formwork elements when said element is mounted on the second support portion; wherein the moment support is designed to support a torque which is exerted on the support head by a vertical load of the floor formwork element mounted on the second support portion.

11. The floor formwork system according to claim 10, wherein the moment support has a supporting portion which is configured to horizontally support the second support portion on a floor formwork element mounted thereon.

12. The floor formwork system according to claim 10, wherein the moment support has two supporting portions which are each designed to horizontally support the second support portion on a floor formwork element mounted thereon;

the two supporting portions supporting the second support portion on the floor formwork element mounted thereon at different heights and in two opposite horizontal directions.

13. The floor formwork system according to claim 8, wherein the formwork supports each have a height-adjustment means for simultaneously adjusting the height of the first and the second support portion.

14. A method for striking formwork from a floor to be produced using a settable filler material such as concrete;

wherein a floor formwork for an underside of the floor to be produced has a plurality of floor formwork elements and a plurality of formwork supports;

wherein at least one of the formwork supports is connected to the support head of claim 1, on which at least one pair of adjacent floor formwork elements of the plurality of floor formwork elements is mounted such that each one of the floor formwork elements of the adjacent pair is mounted on each of the support portions on at least one mounting point; wherein the mounting points have a substantially equal formwork mounting height;

wherein the method comprises:

moving a first of the support portions into an arrangement in which the floor formwork element mounted on the first support portion can be mounted on at least one subjacent mounting point which is at a lower mounting height than the formwork mounting height;

wherein at the lower mounting height, the mounting point of the second support portion remains at the formwork mounting height; and striking the floor formwork element mounted on the first support portion.

15. The method according to claim 14, wherein the floor formwork element mounted on the first support portion is supported by one or more additional supports;

wherein the striking further comprises:

lowering and removing the at least one additional support.

16. The method according to claim 14, wherein the striking further comprises disengaging the floor formwork element mounted on the first support portion from the first support portion.

17. The method according to claim 14, wherein the striking further comprises:

pivoting down the floor formwork element mounted on the first support portion using engagement elements of the first support portion which are in engagement with the pivoted-down floor formwork element during the pivoting down.

18. The method according to claim 14, comprising:

supporting the floor, in a region of the floor from which the formwork has been struck, against the ground, wherein the region from which the formwork has been struck corresponds to a form surface of the floor formwork element mounted on the first support portion.

19. A support head, comprising:

a connecting portion configured to connect the support head to a shaft portion of a formwork support;

two support portions configured to support at least one pair of adjacent floor formwork elements of a plurality of floor formwork elements such that each one of the pair of adjacent floor formwork elements are mountable on each of the support portions on at least mounting point, wherein the at least one mounting point defines a substantially equal formwork mounting head;

an adjustment device configured to move a first support portion into an arrangement in which the floor formwork element, being mountable on the first support portion, can be mounted thereon on at least one subjacent mounting point which is at a lower mounting height than the formwork mounting height, the adjustment device having a guide configured as a rotary sliding guide having an elongate hole for lowering the first support portion in a vertical direction, wherein at the lower mounting height, the mounting point of the second support portion remains at the formwork mounting height.

* * * * *